United States Patent [19]

Bowen et al.

[11] 3,975,780

[45] Aug. 24, 1976

[54] BATHING FACILITY INCORPORATING BATHROOM AIR EXHAUST FANS

[76] Inventors: Duane C. Bowen, 2290 Nob Hill Drive, Carlsbad, Calif. 92008; Troy L. Doan, 924 Phillips, Vista, Calif. 92083

[22] Filed: Mar. 31, 1975

[21] Appl. No.: 563,796

[52] U.S. Cl. ..... 4/146; 4/211; 98/43 R

[51] Int. Cl.[2] ..... F24F 7/06

[58] Field of Search ..... 98/43, 1; 4/146, 211; 312/236

[56] References Cited

UNITED STATES PATENTS

| | | | |
|---|---|---|---|
| 1,978,842 | 10/1934 | Hooton | 4/146 |
| 3,010,116 | 11/1961 | Cowley | 4/146 |
| 3,403,613 | 10/1968 | Huber | 98/43 |
| 3,864,760 | 2/1975 | Bowen | 4/146 |

*Primary Examiner*—William E. Wayner
*Attorney, Agent, or Firm*—Duane C. Bowen

[57] ABSTRACT

The sapce over a shower or tub enclosure, of the type made in one piece of fiber-reinforced plastic, is closed with a dome and a vertical wall extending from the rail, supporting sliding doors, to the ceiling. No finish is required in the end of the bathroom in which the bathing facility is installed and warm and moisture laden air is generally confined to the bathing facility. A bathroom exhaust air housing, connected to a fan and to a conduit to the outside of the building, is installed in the bathing facility above the rail and has grilles in said vertical wall and in the adjacent dome wall. Controls in the housing selectively exhaust air through the grilles directly from the bathroom or from the bathing facility.

18 Claims, 4 Drawing Figures

BATHING FACILITY INCORPORATING BATHROOM AIR EXHAUST FANS

BRIEF SUMMARY OF THE INVENTION AND OBJECTIVES

Our invention relates to incorporating exhaust fan means for a bathroom into a bathing facility.

The invention is an improvement over the prior patent applications of Duane C. Bowen entitled "Improvement in Bathing Facility", one being Ser. No. 247,795, filed 4/26/72, and issued 2/11/75 as U.S. Pat. No. 3,864,760, and the other being Ser. No. 475,404, filed 6/3/74. Both prior applications concerned generally confining warm and moisture laden air to a bathing facility. The second application also concerned integration of a dome top with a bathing facility of the type made in one piece out of fiber-reinforced plastic so that, among other things, no finish is required in the end of the bathroom in which the bathing facility is installed, thereby saving time and materials normally involved in such finish operations.

Exhaust fans for bathrooms are sometimes mandatory and are sometimes an optional but desirable feature. They are usually installed in bathroom ceilings. Extra expense is involved with exhaust fans not only in the cost of the fan assembly but also in the installation. Part of the installation cost is in providing the opening in the plaster board which normally forms the ceiling. Installation of large areas of plastic board is relatively economical (cost per square foot) compared with the cost of smaller areas requiring special cutting and fitting, such as, in one of the problems addressed in the last patent application, the cutting and fitting above a bathing facility, and such as, in a problem concerned in the present invention, accomodating a ceiling exhaust fan. Such special areas also are more difficult in painting. A ceiling fan grille, although it may not be objectionable, is not an ornamental addition and we think bathroom appearance is enhanced by incorporating the grille in the bathing facility. Builders must be cost conscious throughout the various operations involved in residential construction and labor savings made in various aspects of construction cummulate to a very sizable item. It is believed that builders will find important the avoidance of not only finishing operations above a bathing facility but also no plaster board or painting complications in providing a bathroom exhaust fan. One of the objectives of our invention is to accomplish the foregoing, i.e., to incorporate the exhaust fan into the bathing facility to save labor and to improve appearance.

From the viewpoint of the resident, one problem with bathrooms is the clouding of mirrors after bathing facilities are used (as well as moisture condensation elsewhere in the bathroom). Another objective of our invention is to provide an exhaust fan capability to exhaust air from a bathing facility immediately after use in order to minimize passage of moisture-laden air out of a bathing facility into the remainder of the bathroom.

Other objectives of our invention include to best integrate an exhaust fan into a bathing facility, to adapt to requirements wherein the exhaust fan must run whenever bathroom lights are used (sometimes a building code requirement for bathrooms having no exterior walls), and to provide an economical and attractive structure and installation.

Our invention will be best understood, together with additional objectives and advantages thereof, from the following description, read with reference to the drawings, in which.

Figure 1:
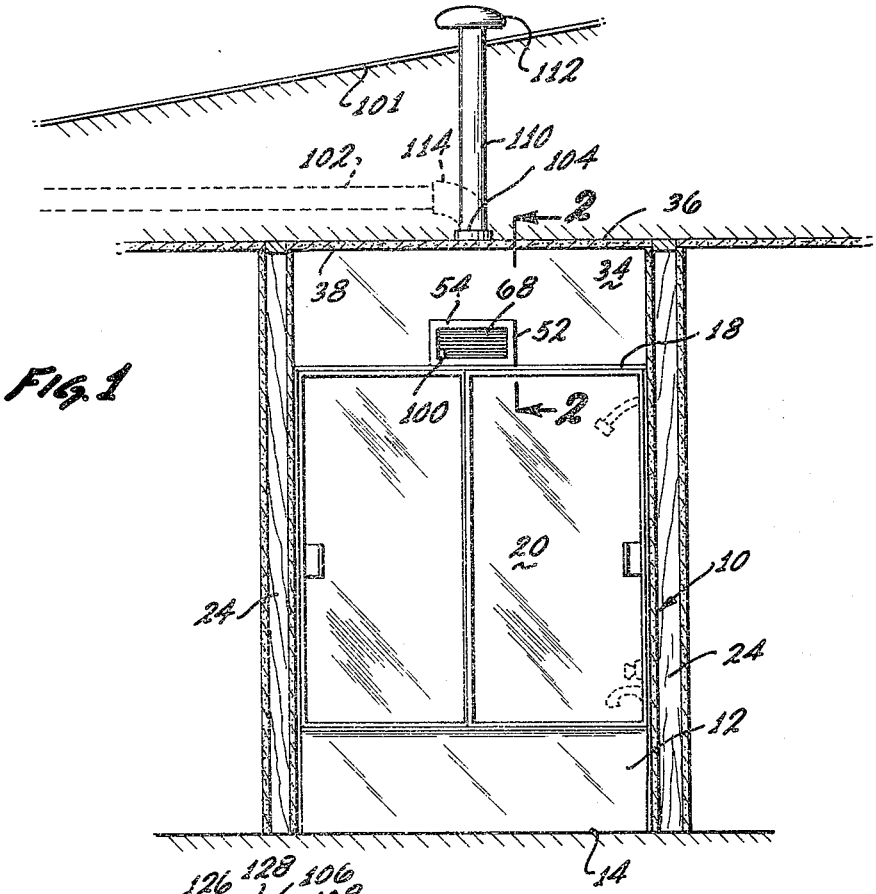
FIG. 1 is a front elevational view, partly in section, of portions of a bathroom and adjacent building structure, showing a specific embodiment of our invention.

The types of bathing facility involved in our invention and some of the associated bathroom structure will be first described for general orientation before describing the details of our invention. The general type of bathing facility and bathroom was described in the above-referenced prior patent applications and the type of top for the bathing facility shown herein was described in detail in the second patent application, Ser. No. 475,404. For this reason, the description of the bathing facility, etc., will be briefer than otherwise would be the case, as the prior applications can be consulted for further details.

The bathing facility lower portion 10 shown is of a type commonly marketed today which is prefabricated as one-piece out of fiber-reinforced plastic and has a bottom portion 12 forming a shower and/or bath floor or tub resting on floor members (flooring, joists, a plywood sheet, etc.) 14. Integral back and end walls 16 rise to near the level of a rail 18 forming tracks that support a bathing facility closure 20, which usually has the form of sliding doors. Walls 16 have flanges 22 which rest against back and end studding 24. The end studding 24 may be the regular studding of the bathroom or at least one set of studding may be that of a stub wall located to fit and support the bathing facility. In either case the bathing facility can be said, for convenience in this specification and in the claims, to fill an end of the bathroom between the end studding 24, whether this fills a full or part wall or is located in a wall considered an end or side of the bathroom.

Top 30 has a form shown and described in more detail in Ser. No. 475,404 and includes a dome 32, a front vertical wall 34 to ceiling members 36 (and secured thereto by flange 38), and back and end flanges 40 abutting flanges 22 and secured thereto by clips 42.

Top 30, it will be observed, forms a cover for the bathing facility and, together with lower portion 10, forms generally watertight walls, for the bathing facility. By this we mean that although the sliding doors 20 are not airtight, they are designed to prevent passage of water and the lower portion 10 and top 30 of the bathing facility can be substantially watertight. Bathing is made more comfortable by confining heated and water-laden air, when doors 20 are closed, as contrasted to the normal bathing facility without a top in which the heated and moisture-laden air escapes over rail 18 into the remainder of the bathroom. A companion effect is to prevent escape of most of the moist air from the bathing facility, at least until doors 20 are opened, so there is less moisture to condense on mirrors and other surfaces of the bathroom outside of the bathing facility.

Another result of the use of top 30 is that labor and materials do not need to be used to finish the walls and ceiling above lower bathing facility 10.

Our exhaust fan system is shown and will be described in the specific embodiment of this patent application as installed in the bathing facility structure just described. It will be evident, however, that the exhaust fan system would have application to a bathing facility of modified design, i.e., top and lower sections could be divided at a different point or molded in one integral structure. One reason for providing a two-section bathing facility concerns methods of molding, wherein the molder might have to try to resort to a collapsible male form to accomodate one-piece molding.

One important feature of our exhaust fan system is integration into the bathing facility so that a separate installation does not have to be made elsewhere in the bathroom (usually in the ceiling). This is like the saving of not having to finish walls and ceiling over the bathing facility, but in the case of the exhaust fan the primary saving is in terms of labor. As before stated, plaster board (dry wall) installation goes fast by those skilled in the art in large or solid wall areas. Time is consumed at a much higher rate, considering the areas involved, when the plaster board must be cut and fitted (and measurements must be carefully made and followed). In a bathroom ceiling exhaust fan installation, commonly the fan will be located in an area that otherwise would be simply covered by a 4 foot × 8 foot sheet. Instead, the plaster board must be cut to provide an opening for the exhaust fan at the right location. The labor savings of incorporating the exhaust fan into the bathing facility will be particularly noticeable in apartment or tract developments wherein many bathrooms are involved. Builders of such multiple units are particularly conscious of the importance of savings in materials and time in the various items that add together to make the basic cost of construction. Another way to view the savings is to compare the cost of the labor of installation with the cost of the raw hardware and it will be observed that installation labor is significant percentage-wise relative to the hardware, which follows the general principle that mass-produced subjects are surprisingly economical compound with those subjects that can not be given mass-production (or standardization) savings.

We will now describe the integration of the exhaust fan system into the bathing facility. The structure shown has a dual capacity, which accounts for aspects of its location and structure. This dual capability is to exhaust either directly from the bathroom outside of the bathing facility or directly from the bathing facility (and only indirectly from the bathroom, i.e., if the sliding doors 20 are closed then the only air from outside of the bathing facility would be that leaking past the doors). The dual exhaust can be most economically accomplished if the air inlets can be located in adjacent walls. For this reason, front vertical wall 34 and the forward wall 50 of dome are selected.

Figure 2:
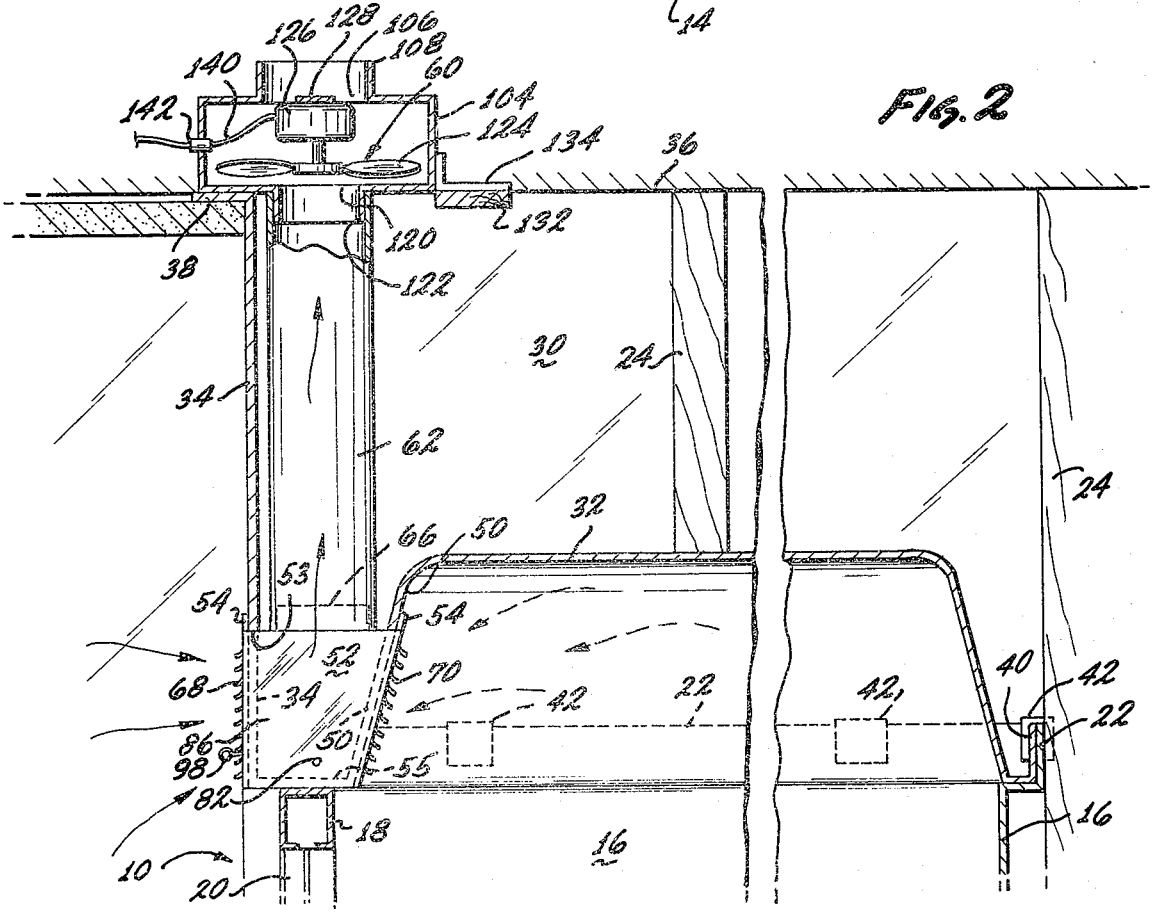
FIG. 2 is an enlarged elevational view, of portions of the assembly, partly in section, taken on line 2 — 2 of FIG. 1.
Figure 3:
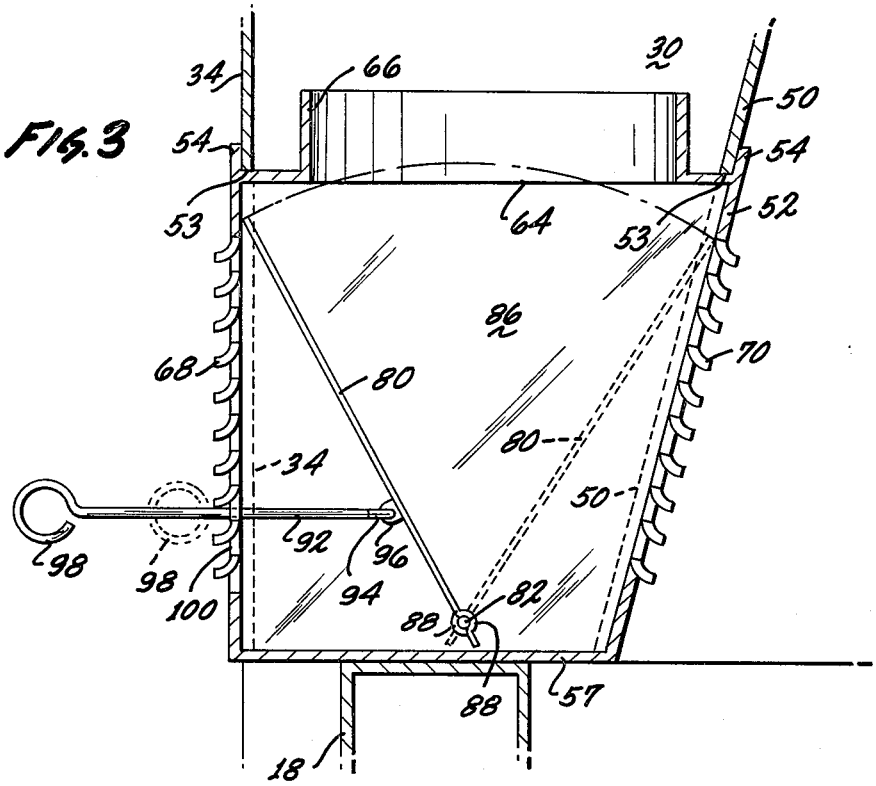
FIG. 3 is an enlarged end view, partly in section, of an air outlet housing and portions of surrounding structure.

The normal outline of walls 34 and 50 will be best understood from the dotted lines in FIG. 3. They are nearly the same contours as the associated air inlet housing 52 except housing 52 may be made with upper and side flanges 54 to lap the adjacent margins of walls 34 and 50 and the remainder of those housing walls may be made flush with the outer surfaces of flanges 54 so as to extend slightly beyond the surfaces of walls 34 and 50. Flanges 54 merely lap the associated margins of walls 34 and 50 but they could be made U-shaped to receive those margins (or inner clips could be provided) if walls 34 or 50 didn't make a good fit to the flanges as shown. Housing 52 can be said to fit in a cut-out 53 in walls 34, 50 and in the horizontal wall 55, above rail 18, connecting them, which is indicated in dashed lines in FIG. 2 and is partly seen in FIG. 4. The recess 53 may be actually cut out from walls 34, 50, 55 that are molded without recess 53 but it is more likely that top 30 will be molded to form recess 53, so the expression cut-out means that opening 53 has the same shape as if walls 34, 50, 55 had been cut on side vertical and top horizontal lines, rather than measuring the formation of recess 53 actually was by cutting.

It would be possible to fit a fan into an air outlet housing 52 much as is shown but that is not the design choice made partly for two reasons: (a) Walls 34, 50 can be relatively close (they can be closer than shown) if space does not have to be provided for the diameter of a fan. Of course housing 52 could be given more height to an area higher on the dome with more space to accomodate a fan diameter. (b) It is imperative that the inside of the bathing facility be insulated from electrical connection to the fan. If housing 52 were formed of metal and if the fan were mounted in or on the housing, a short would be possible so that the user (connecting to water as ground) could be shocked if he touched the housing.

Instead of incorporating fan 60 into housing 52, we have located fan 60 remotely. Either housing 52 or the pipe 62 connecting to the fan should be made of plastic in order to eliminate any chance of electrical transmission. Preferably, housing 52 would be made at least partly of plastic. In that way, there could be no chance of danger in case an installer substituted a metal pipe 62 for a plastic pipe. In other words, we prefer that at least enough plastic is used in housing 52 to avoid electrical transmission, in which case pipe 62 may be of metal. This suggests selection of a plastic matching the rest of the bathing facility, to make the housing relatively unobstrusive. Such plastic matching further relates to a point of the present invention on aesthetics, that we believe incorporating the exhaust fan grille into the bathing facility (and particularly when it is of the same color — usually white — and perhaps the same material) has a better appearance than an exhaust fan elsewhere, i.e., in the middle of the ceiling.

Housing 52 has an upper opening 64 and an annular flange 66 therearound to connect to pipe 62. Front and rear walls are provided with grilles 68, 70. Grilles 68, 70 can have any form as their function is decorative and they are not needed functionally, although usually they will be provided according to conventional design. Selective air outlet from inside or outside of the bathing facility could be provided merely by substituting doors for grilles 68, 70 or by applying doors to grilles 68, 70 if they were deemed important.

We have not detailed how housing 52 is fabricated as this depends on the choice of material or materials and on the selection of fabrication technique. Joinder of parts to form a housing 52 is susceptible of various design choices and economy of manufacture can be a controlling consideration. It should be observed that some walls of housing 52 could be integrated into the molding of top 30. For example, housing end walls 86 and the top including opening 64 could be molded as integral parts with walls 34, 50, so that the inserted housing structure could be merely the housing bottom, front and back walls 57, 68, 70. Molding, instead, of bottom, front and back walls 57, 68, 70 would be difficult because of grille work in walls 68, 70.

Figure 4:
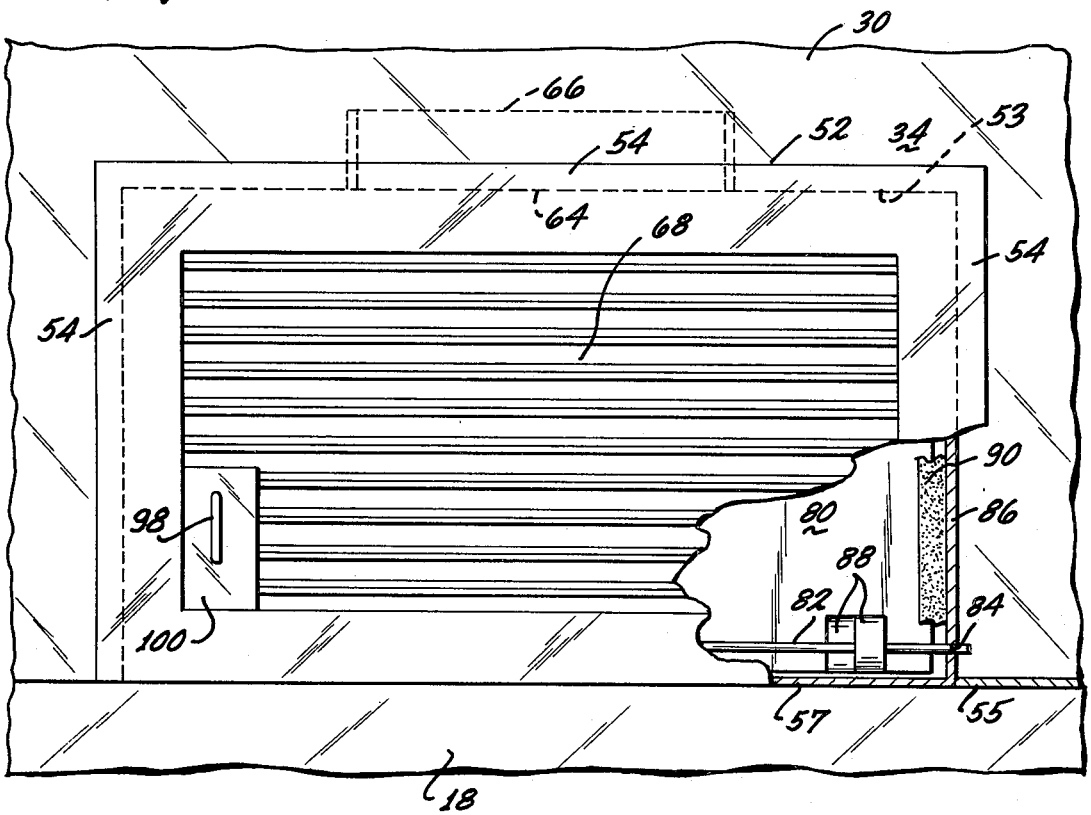
FIG. 4 is a face view of the front grille of the air outlet housing and some surrounding structure, portions of the grille being broken away to provide a view of structure that otherwise would be hidden.

There are various ways to form such a housing 52 with air-directing or air-blocking means so that air will be picked up from only one grille 68, 70 at a time, including merely doors as mentioned above, register-type louver closures, etc. The air control means shown is thought to be simple, economical and effective and has the form of a plate 80 pivotally mounted about the rod 82 which is set in openings 84 in the end walls 86 of housing 52. Rod 82 is connected to the lower portion of plate 80. A simple connecting system for a metal blade would be to bend out paired portions 88 between parallel cut lines in plate 80 as shown in FIGS. 3 and 4. Plate 80 controls air merely by being leaned against the front or rear housing wall, above grille 68 or grille 70 respectively, so that air can pass only in one or the other grille. If plate 80 does not fit as tightly as desired, marginal flexible strips (i.e., rubber strips) 90 can be used on its edges. Absolute sealing of the edges of plate 80 is not required but when a person is bathing there should not be enough air leakage through grille 70 to cause a current of air to be formed that is at all chilling. Plate 80 can be brought forwardly or forced rearwardly by a rod 92 (that can be formed of wire) having a hook 94 on its inner end securing in an opening in small flange 96 on one end of plate 80 and having a loop 98 at its outer end to be grasped. Grille 68 can have a solid corner 100 with an opening to accept rod 92. We have shown only one rod 92, assuming that air control from the outside of the bathing facility would be sufficient, but another similar rod can be provided through grille 70 to the inside if desired.

Having thus described the two grilles 68, 70, we will now discuss the reason why control of air exhaust from either the inside or outside of the bathing facility is desirable. One reason to have an exhaust fan in a bathroom is a requirement of some building codes that a bathroom without an outside wall or without a window must have an exhaust fan, and the exhaust fan must be connected to the wiring for the bathroom lights so that the fan runs whenever the lights are on. To merely make the minimum compliance with such a code, our system of integrating the exhaust fan with the bathing facility would require only one air opening, which could be through grille 68, or, in fact, could be located at any other suitable place in the bathing facility. Of possible locations, wall 34 would be a logical choice. If there were to be only one air opening, selection of a location within the interior of the bathing facility would not be a good choice in an installation in which the fan had to run whenever the bathroom lights were on according to a building code, because this would mean there would be an appreciable air current within the bathing facility when someone was bathing, which would be unpleasant even to those accustomed to a short or even a cold shower and would be contraindicated for users wanting a long, warm shower or tub bath. Note, however, that one air opening within a bathing facility would be a possible choice for installations in which there was no code requirement requiring connection of fan activation to the light switch, because the fan could be switched on only when it was desired to expell odors (indirectly from the bathroom proper through the bathing facility) or to exhaust moisture-laden air from the bathing facility after use in order to minimize condensation of water on mirrors or on other surfaces in the bathroom.

As indicated, two reasons to have an exhaust fan in a bathroom are to exhaust odors and to expel moisture-laden air after a shower or bath. The use of an exhaust fan with two air openings 68, 70 in the case wherein there is no code requirement for any exhaust fan and the exhaust fan circuit may not be tied to the bathroom lighting circuit means that the builder has elected to provide a good facility that can be selectively operated either for good, direct general bathroom ventilation or for good, direct exhaust of warm, moisture-laden air from a bathing facility. As to the latter function, merely providing a top for a bathing facility has some effect in reducing mirror clouding. Use of any exhaust fan after bathing will further reduce mirror clouding or reduce the length of time of clouding. Additional reduction of mirror clouding will occur if the bathing facility has a top and if air is exhausted with a fan directly from the bathing facility after bathing. Our system would be best operated for the purpose of reducing moisture condensation if the exhaust fan if run during bathing with plate 80 covering vent 70 so as to exhaust moist air leaking past sliding doors 20 and if plate 80 is moved to cover vent 68 when the user leaves the bathing facility (and preferably shuts doors 20 behind him). Minimizing mirror clouding after a bath or shower will be important to some people who may want to dress hair, shave, apply makeup, etc., with use of the mirrors immediately after bathing.

In the case of a bathroom wherein an exhaust fan is activated by the bathroom light switch, the dual exhaust air openings 68, 70 is valuable for much of the same reasons, although there is not an option to not use the fan (as a light will usually be used during bathing in a bathroom without windows for lighting). In this case, it is felt that the integration of the exhaust fan into the bathing facility is as economical expedient for the reasons set forth before, and as long as the air outlet will be connected with the bathing facility, one might as well undergo the small additional expense to provide the dual exhaust air openings described in order to have improved operation.

FIGS. 1 and 2 show the conduits to exhaust air from the building. As is well known in the construction industry, exhaust fan venting may be to the roof 101 as shown in full lines in FIG. 1 or may be to side wall as indicated in dashed lines 102. The same fan housing 104 can be used in either case with an upper opening 106, and an annular flange 108 about the opening to fit with either a straight conduit 110 to the roof 101 (having a shield 112 to prevent rain from entering pipe 110) or an elbow 114 connecting with tubing 102.

Housing 104 also has a bottom opening 120 with an annular flange 122 connecting to pipe 62. Fan 60 may be mounted with the blade 124 below and the motor 126 above or with the reverse orientation. As shown, motor 126 is mounted on an arm 128 extending across opening 106. If a straight pipe 62 is used, location of housing 104 is controlled by the location of walls 34, 50 of the bathing facility, etc., and may not be located adjacent to a ceiling joist 36, so I have shown a 1 inch × 4 inches board 132 for mounting of fan housing 104 (by means of a bracket 134 suitably secured to board 132 and to housing 104) to the extent mounting is needed. The direction of board 132 depends on the direction of joists 36. An electrical line 140 is shown connected to motor 126. The member 142 represents passage of the electrical source to the outside of housing 104 and can be a nonconducting bushing, a plug and receptacle, etc. As before indicated, electrical line 140 may be connected to a bathroom light switch or may have a separate switch, depending most often on building code considerations.

The construction shown of the fan system 60, including housing 104, etc., is, of course, merely one configuration and could have any suitable construction as long as it exhausted air from air openings 68, 70. We do not mean to exclude the possibility of integration of fan 60 with air outlet housing 52, as before related, but such integration does pose the problem of satisfying not only the designer but also governmental authorities that there is no possibility of shortage of electrical components to anything a bather in the bathing facility could touch. A second consideration can be one of accommodating the needed space for a fan especially between walls 34, 50. Housing 52, of course, does not have to fit in a cut-out 53 in walls 34, 50, 55, and could be located higher where there is more space in top 30, although the cut-out is an economical expedient. Whatever the configuration, mounting of the exhaust fan air outlet or outlets in the bathing facility is advantageous for the reasons set forth and some type of dual selective exhaust openings 68, 70 has additional advantages.

Having thus described our invention, we do not wish to be understood as limiting ourselves to the details of the specific embodiment. Instead, we wish to cover those modifications of the structure which will occur to those skilled in the art after learning of our invention and which properly fall within the scope of our invention.

We claim:

1. In a bathroom having a prefabricated bathing facility factory manufactured separately and placed in an end of said bathroom, said bathroom having been constructed as a part of a building, said bathroom having floor members, ceiling members, and studding forming a first bathroom rear wall and second and third bathroom end walls meeting said rear wall at right angles, said bathing facility being molded and being made primarily of plastic material, said facility having a top horizontal rail and a front closure supported from said rail, said facility resting on said floor members and extending upwardly to a level near to the height of said rail and spaced from said ceiling members, said facility having a bottom and having rear and end walls rising from said bottom to said level and respectively secured to and resting against said first rear wall and said second and third end walls, means forming a top for said bathing facility and providing exhaust fan means for said bathroom, comprising:

a. a prefabricated sheet-like body of molded plastic material forming the top of said bathing facility,
b. said body including an upright wall extending substantially vertically from said ceiling members to the top of said rail and from said second to said third bathroom end wall,
c. said body extending from near the top of said rail rearwardly and ending in rear and end portions joining the upper portions of said rear and end walls of said bathing facility to form together therewith rear, end, top and bottom generally watertight walls for said bathing facility,
d. said ceiling members and said first, second and third bathroom walls being unfinished above, to the rear of and to the ends of said sheet-like body, said bathing facility and said sheet-like body together providing the finish for said end of said bathroom,
e. an air outlet in at least one of the walls formed by said facility and body,
f. conduit means connecting said air outlet to the exterior of said building to exhaust air from said bathroom out of said building, and
g. fan means operative to pull air from said bathroom into said air outlet and to force said air through said conduit means out of said building, said air outlet, conduit means and fan means being the sole exhaust fan means from said bathroom and bathing facility to outside of said building.

2. The subject matter of claim 1 in which said air outlet is disposed in said upright wall.

3. The subject matter of claim 2 in which said air outlet is disposed adjacent to said rail.

4. The subject matter of claim 1 in which said air outlet is disposed in the upper, inside portion of said bathing facility.

5. The subject matter of claim 1 in which said air outlet has a first opening disposed in said upright wall and a second opening disposed in the upper, inside portion of said bathing facility so as to be operative to draw air from the bathroom outside of said bathing facility and to draw air from within said bathing facility.

6. The subject matter of claim 5 in which there is air control means operable to control whether air is drawn through said first or said second opening and manually operable means operative to control said air control means.

7. The subject matter of claim 1 in which said air outlet includes a housing, the upper, inside portion of said bathing facility above said rail including an upstanding wall justaposed to and spaced from said upright wall, there being a cutout in said upright wall and said upstanding wall to said rail and said housing fitting in said cutout, said housing having inner and outer walls generally in the plane of said upstanding and upright walls respectively and having inner and outer grilles in said inner and outer walls.

8. The subject matter of claim 7 in which there is air control means operable to control whether air is drawn through said first or said second grille and manually operable means operative to control said air control means.

9. The subject matter of claim 8 in which said air control means includes an upright plate extending from end to end inside of said housing and means at the lower portion of said plate hingedly mounting said plate whereby said plate can have a position bearing on the inside of said housing above said first grille to prevent air from passing through said first grille or a position bearing on the inside of said housing above said second grille to prevent air from passing through said second grille, whereby control is provided as to whether air is drawn directly out of said bathroom outside of said bathing facility or is drawn from out of the inside of said bathing facility.

10. The subject matter of claim 9 in which said manually operable means is a rod connected to said plate and extending to outside of said housing so as to be manually manipulated to selectively locate said plate.

11. In a bathroom having a prefabricated bathing facility factory manufactured separately and placed in an end of said bathroom, said bathroom having been constructed as a part of a building, said bathroom having floor members, ceiling members, and studding forming a first bathroom rear wall and second and third bathroom end walls meeting said rear wall at right angles, said bathing facility being molded and being made primarily of plastic material, said facility having a top horizontal rail and a front closure supported from said rail, said facility resting on said floor members and extending upwardly to a level near to the height of said rail and spaced from said ceiling members, said facility having a bottom and having integral rear and end walls rising from said bottom to said level and respectively secured to and resting against said first rear wall and said second and third end walls, means forming a top for said bathing facility and providing exhaust fan means for said bathroom, comprising:

a. a prefabricated, one-piece sheet-like body of molded plastic material forming a top for said bathing facility, b. said body including an upright wall extending substantially vertically from said ceiling members to the top of said rail and from said second to said third bathroom end wall, c. said body extending from near the top of said rail rearwardly and ending in rear and end portions meeting the upper portions of said rear and end walls of said bathing facility to form together therewith rear, end, top and bottom generally watertight walls of said bathing facility, d. said ceiling members and said first, second and third bathroom walls being unfinished above, to the rear of and to the ends of said sheet-like body, said bathing facility and said sheet-like body together providing the finish for said end of said bathroom, e. air outlet means in said body forming said top, f. conduit means connecting said air outlet means to the exterior of said building to exhaust air from said bathroom out of said building, and g. fan means operative to pull air from said bathroom into said air outlet and to force said air through said conduit means out of said building, said air outlet means, conduit means and fan means being the sole exhaust fan means from said bathroom and bathing facility to outside of said building.

12. The subject matter of claim 11 in which said air outlet means is disposed in said upright wall.

13. The subject matter of claim 11 in which said air outlet means is disposed inside of said bathing facility and passes through said top formed by said sheet-like body.

14. The subject matter of claim 11 in which said air outlet means has a first opening disposed in said upright wall and a second opening disposed in the upper, inside portion of said bathing facility so as to be operative to draw air from the bathroom outside of said bathing facility and to draw air from within said bathing facility.

15. The subject matter of claim 14 in which there is air control means operable to control whether air is drawn through said first or said second opening and manually operable means operative to control said air control means.

16. The subject matter of claim 11 in which said air outlet means includes a housing, the upper, inside portion of said bathing facility being domed and having a front wall juxtaposed to and spaced from said upright wall, there being a cutout in said upright wall and said front dome wall to said rail and said housing fitting in said cutout, said housing having inner and outer walls generally in the planes of said front dome wall and said upright wall respectively and having inner and outer grilles in said inner and outer walls.

17. The subject matter of claim 16 in which there is air control means operable to control whether air is drawn through said first or said second grille and manually operable means operative to control said air control means.

18. The subject matter of claim 17 in which said air control means includes an upright plate extending from end to end of said housing and means at the lower portion of said plate hingedly mounting said plate whereby said plate can have a position bearing on the inside of said housing above said first grille to prevent air from passing through said first grille or a position bearing on the inside of said housing above said second grille to prevent air from passing through said second grille, whereby control is provided as to whether air is drawn directly out of said bathroom outside of said bathing facility or is drawn from out of the inside of said bathing facility.

* * * * *